US011731193B2

(12) United States Patent
Wang et al.

(10) Patent No.: US 11,731,193 B2
(45) Date of Patent: Aug. 22, 2023

(54) PREPARATION METHOD OF IMPROVED SINTERED NEODYMIUM-IRON-BORON (ND—FE—B) CASTING STRIP

(71) Applicant: Baotou Jinshan Magnetic Material Co.,Ltd., Inner Mongolia (CN)

(72) Inventors: Yu Wang, Inner Mongolia (CN); Feng Xia, Inner Mongolia (CN); Caina Sun, Inner Mongolia (CN); Yonghuai Feng, Inner Mongolia (CN); Yanli Li, Inner Mongolia (CN); Jiao Gao, Inner Mongolia (CN); Jixiang Liu, Inner Mongolia (CN)

(73) Assignee: BAOTOU JINSHAN MAGNETIC MATERIAL CO., LTD., Inner Mongolia (CN)

( * ) Notice: Subject to any disclaimer, the term of this patent is extended or adjusted under 35 U.S.C. 154(b) by 148 days.

(21) Appl. No.: 17/360,540

(22) Filed: Jun. 28, 2021

(65) Prior Publication Data

US 2022/0219228 A1 Jul. 14, 2022

(30) Foreign Application Priority Data

Jan. 12, 2021 (CN) ..... 202110036074.0

(51) Int. Cl.
*B22D 21/02* (2006.01)
*H01F 1/057* (2006.01)
(Continued)

(52) U.S. Cl.
CPC ..... *B22D 21/025* (2013.01); *H01F 1/0577* (2013.01); *H01F 7/02* (2013.01); *H01F 41/0253* (2013.01); *C22B 9/16* (2013.01)

(58) Field of Classification Search
CPC ..... H01F 1/0577
See application file for complete search history.

(56) References Cited

U.S. PATENT DOCUMENTS 7,846,273 B2 * 12/2010 Sasaki ..... C22C 38/005 252/62.55
2017/0372823 A1 * 12/2017 Ding ..... C22C 38/10

FOREIGN PATENT DOCUMENTS

CN 103103442 A 5/2012
CN 104752048 A * 7/2015

OTHER PUBLICATIONS

Machine translation of CN104752048A (Year: 2015).*
Machine translation of CN104252939A (Year: 2014).*

* cited by examiner

*Primary Examiner* — Brian D Walck
*Assistant Examiner* — Nazmun Nahar Shams
(74) *Attorney, Agent, or Firm* — Hayes Soloway PC

(57) ABSTRACT

A preparation method of improved sintered neodymium-iron-boron (Nd—Fe—B) casting strips includes the following steps: firstly nucleation assisted alloy particles used for sintered Nd—Fe—B casting strips are prepared, all elements are weighted as follows: 26.68-28% of Pr—Nd, 70-72.5% of Fe and 0.90-1% of B, and a Pr element in two elements of Pr—Nd accounts for 0-30 wt %; the compounded materials are smelted and poured to obtain alloy strips, then the alloy strips are crushed into particles with diameter of 1-10 mm; secondly, Nd—Fe—B casting strips are prepared: the prepared intermediate materials are smelted and melted into molten steel, and then are refined; after the intermediate materials are fully melted, the nucleation assisted alloy particles are added; and after the nucleation assisted alloy particles are added, smelting is performed for 3-15 minutes pouring is performed, and final Nd—Fe—B alloy casting strips are obtained.

9 Claims, 1 Drawing Sheet

(51) Int. Cl.

| | |
|---|---|
| ***H01F 7/02*** | (2006.01) |
| ***H01F 41/02*** | (2006.01) |
| ***C22B 9/16*** | (2006.01) |

PREPARATION METHOD OF IMPROVED SINTERED NEODYMIUM-IRON-BORON (ND—FE—B) CASTING STRIP

CROSS REFERENCE TO RELATED APPLICATION(S)

This patent application claims the benefit and priority of Chinese Patent Application No. 202110036074.0, filed on Jan. 12, 2021, the disclosure of which is incorporated by reference herein in its entirety as part of the present application.

TECHNICAL FIELD

The present disclosure belongs to the technical field of preparation of rare earth permanent magnetic materials, and particularly relates to a preparation method of improved sintered neodymium-iron-boron (Nd—Fe—B) casting strips.

BACKGROUND ART

Since their invention in 1983, sintered neodymium-iron-boron (Nd—Fe—B) permanent magnetic materials have been greatly developed and applied and have become an important industry. Through research, commercial production of high-magnetic-energy-product magnets is realized, and magnetic properties have been rapidly improved. However, restricted by an Nd—Fe—B powder metallurgy technology, further improvement of the magnetic properties requires improvement of a material microstructure, and mainly depends on the step of producing casting strips in the preparation process of sintered Nd—Fe—B. The microstructure of alloy casting strips obtained in the step will be inherited into final finished products, which directly affects the final microstructure of magnet finished products. However, it is very difficult to improve the microstructure of the Nd—Fe—B alloy casting strips. A current preparation technique of high-temperature alloy materials is not perfect from theory to practice.

SUMMARY

A traditional production technology process of sintered neodymium-iron-boron (Nd—Fe—B) finished products includes material compounding, strip casting, powder preparation, forming, sintering, machining, electroplating and the like. During the strip casting, compounded materials are smelted at one time to obtain alloy casting strips.

The present disclosure provides a method for preparing Nd—Fe—B casting strips by adding nucleation assisted alloys to improve the microstructure of Nd—Fe—B alloy casting strips and substantially improve the properties of magnets under the premise of the same formula.

The present disclosure relates to a preparation method of improved sintered Nd—Fe—B casting strips. The method includes the following steps:

1) Nucleation assisted alloy particles (material A) used for sintered Nd—Fe—B casting strips are prepared.

1.1) Nucleation assisted alloy particle elements may be weighted as follows: 26.68-28% of Pr—Nd, 70-72.5% of Fe and 0.90-1% of B, where a Pr element in two elements of the Pr—Nd may account for 0-30 wt %, an Fe element in the nucleation assisted alloy particles can be replaced with part of a Co element, the Co element may account for 0-5 wt % in the material A, and alloy strips with proportion of ingredients close to that of $(Pr—Nd)_2Fe_{14}B$ may be obtained through conventional compounding, smelting and pouring, mainly contain tetragonal phases and a few Nd-enriched phases, and have grain size of 5-30 μm.

1.2) The alloy strips may be crushed into particles with diameter of 1-10 mm by a mechanical crushing method or a hydrogen crushing method, to be used as the nucleation assisted alloy particles used for the sintered Nd—Fe—B casting strips. In some embodiments, the mechanical crushing method is preferably selected. If the hydrogen crushing method is adopted, dehydrogenation needs to be as sufficient as possible, and hydrogen content may be smaller than 1000 ppm, preferably smaller than 600 ppm to reduce influence on smelting.

2) Nd—Fe—B alloy casting strips (material C) are prepared.

2.1) Alloy ingredients may be designed according to marks of the casting strips: as the nucleation assisted alloy particles need to be added to materials finally, the addition of the nucleation assisted alloys may influence final alloy ingredients. In order to obtain ingredients of final Nd—Fe—B alloy casting strips, ingredients of materials before addition of the nucleation assisted alloy particles, namely ingredients of intermediate materials, may be designed and calculated. The nucleation assisted alloys may be added with a weight percent of 3-6 wt %. In some embodiments, the nucleation assisted alloys may be added with a weight percent of 5%.

2.2) The intermediate materials may be smelted and melted into molten steel according to a conventional sintered Nd—Fe—B smelting technology, and then may be refined after the intermediate materials are fully melted. The nucleation assisted alloy particles are added, and smelting may be performed for 3-15 minutes under the condition that power is reduced by 150-250 KW. Pouring may be performed, and final Nd—Fe—B alloy casting strips are obtained.

The Specific Working Principle of the Present Disclosure Lies in that:

1) The element ingredients of the nucleation assisted alloys may be weighted as follows: 26.68-28% of Pr—Nd, 70-72.5% of Fe and 0.90-1% of B. The ingredient ratio may determine that the nucleation assisted alloys mainly contain $Nd_2Fe_{14}B$ tetragonal phases and basically do not contain Nd-enriched phases and have large grain size of 5-30 μm. After crushing, $(Pr—Nd)_2Fe_{14}B$ particles may be obtained. The tetragonal-phase nucleation assisted alloys may be used as a nucleation point, and formation of tetragonal-phase columnar crystals from the Nd—Fe—B casting strips in the pouring process may be better facilitated.

2) In the process of preparing the Nd—Fe—B casting strips, compared with a pouring time, the time for adding the nucleation assisted alloy particles, namely material A, cannot be too early, otherwise the temperature may be too high and the material A and the intermediate materials may be melted together. In this instance, the meaning of adding the material A and the intermediate materials separately is lost, and the time for adding the nucleation assisted alloy particles, namely the material A, cannot be too late. Otherwise, the nucleation assisted alloys remain solid small grains and a nucleation effect cannot be achieved. In some embodiments, the nucleation assisted alloys may be close to a softened state and atomic clusters may be in a short-range order. Although all atoms may still be in a highly-active state, the atoms may also be limited by a crystal lattice. Thus, in the pouring process, the atoms in intermediate material molten steel may achieve nucleation growth by relying on an inherent crystal structure of the nucleation assisted alloys to obtain a desired microstructure.

3) The nucleation assisted alloys may be added after the intermediate materials are melted and smelted for 10-20 minutes. After the nucleation assisted alloys are added, smelting may be performed for 3-15 minutes under the condition that power may need to be reduced by 150-250 KW. Pouring may then be performed so that the nucleation assisted alloys in the molten steel are softened, but may not be in a free atom state completely.

The preparation method has the following technical effects that after the technology and the technique are adopted, the metallographic phase quality of the casting strips is improved, and the intrinsic coercivity Hcj of magnet finished products prepared from the casting strips is improved.

BRIEF DESCRIPTION OF THE DRAWINGS

FIG. 1A shows an image of the metallographic phases by a nucleation assisted technique. FIG. 1B shows an image of the metallographic phases by the traditional technology; FIG. 2A shows an image of the metallographic phases by a nucleation assisted technique. FIG. 2B shows an image of the metallographic phases by the traditional technology.

DETAILED DESCRIPTION OF THE EMBODIMENTS

Figure 1A:
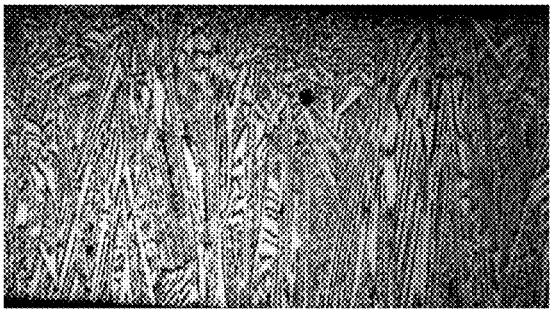
FIGS. 1A and 1B show a comparison of metallographic phases of casting strips obtained by a technique disclosed by the present disclosure and those by a traditional technology.

To enable those skilled in the art to better understand the technical solution of the present disclosure, the present disclosure will be described in detail below with reference to the accompanying drawings. The description in this section is merely exemplary and explanatory and should not have any limitation on the scope of protection of the present disclosure.

Example 1

1) A formula of nucleation assisted alloys (A material) in the example was designed as: Pr—$Nd_{28}Fe_{69.5}Co_{1.5}B_1$, with an added weight percent of 5%, where the ingredients of the alloys were calculated before addition of the nucleation assisted alloys according to the design, and ingredients of the intermediate materials were obtained as follows:

Pr—$Nd_{25.9}Dy_{4.42}Fe_{bal}Co_{1.5}B_{0.98}M_{0.96}$ (M=Al, Cu, Nb, Ga), where M was an impurity element, and bal represented balance; and the intermediate materials accounted for 95% in the final Nd—Fe—B casting strips (C materials). The final formula of the Nd—Fe—B casting strips (C materials) was designed as (in a weight percent): Pr—$Nd_{26}Dy_{4.2}Fe_{bal}Co_{1.58}B_{0.98}M_{0.90}$ (M=Al, Cu, Nb, Ga).

2) The nucleation assisted alloys (A materials) were smelted. The compounded A materials were added into a smelting crucible, vacuumizing was performed until the intensity of pressure was smaller than or equal to 0.5 Pa, and the materials were heated and baked at a low power for 20 minutes. The materials were heated and baked at the largest power of 580 KW until furnace materials were melted through visual observation. Smelting was performed for 12 minutes under the condition that the power was reduced by 100 KW. The molten steel was poured out when the temperature of the molten steel was in the range of 1430-1450° C. During pouring, the rotating speed of a copper roller wheel of a smelting furnace was about 30-35 r/min. The linear speed of a corresponding molten steel swinging position was 0.96-1.12 m/s, and casting strips with thickness of 0.25-1 millimeter were obtained.

The casting strips were crushed into particles with particle size diameter of about 1-10 mm by a mechanical crushing method as the nucleation assisted alloy particles.

3) The Nd—Fe—B casting strips (C material) were smelted. 570 Kg of the compounded intermediate materials were added into the smelting crucible, vacuumizing was performed until the intensity of pressure was smaller than or equal to 0.5 Pa, and the materials were heated and baked at a low power for 20 minutes. The materials were heated and baked at the largest power of 580 KW until the furnace materials were melted. Smelting was performed for 20 minutes after the smelting power was slightly regulated down to 480 KW. The nucleation assisted alloys, namely the materials A, were added through a special tool for later-added materials, arranged at a top end, and after the materials A were added, smelting was performed for 15 minutes after the power was regulated down to 300 KW, so that the nucleation assisted alloys, namely the materials A, in the molten steel were softened but not in a free atom state completely. The molten steel was poured out when the temperature was in the range of 1390-1400° C. During pouring, the rotating speed of the copper roller wheel of the smelting furnace was about 40-45 r/min, the linear speed of the corresponding molten steel swinging position was 1.28-1.44 m/s, and casting strips with thicknesses of 0.15-0.35 millimeter were obtained.

Figure 1B:
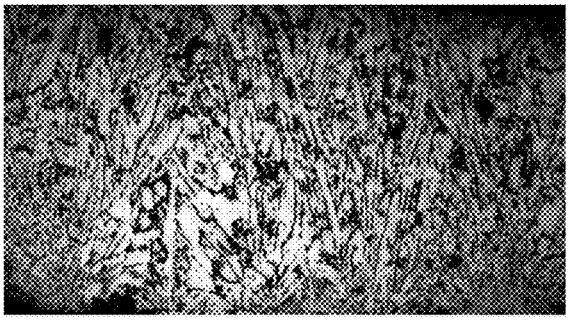

Finally, with the same ingredients, comparison of metallographic phases of casting strips obtained by a technique disclosed by the present disclosure and those by a traditional technology was obtained. FIG. 1A shows an image of the metallographic phases by a nucleation assisted technique, and FIG. 1B shows an image of the metallographic phases by the traditional technology.

The Nd—Fe—B casting strips were then subjected to conventional crushing and powdering, pressing and forming, and sintering so that the Nd—Fe—B finished products were obtained. A comparison table of properties of Nd—Fe—B finished products obtained by different technologies with the same ingredients is shown in the following Table 1. 1-1 # to 1-3 # show the properties of Nd—Fe—B magnets obtained by adopting the technique disclosed by the present disclosure, and 1-4 # to 1-6 # show the properties of Nd—Fe—B magnets obtained by adopting the traditional technology.

TABLE 1

Comparison table of properties of Nd—Fe—B finished products obtained by different technologies with the same ingredients.

| SN | Br(T) | Hcj(kAm/s) | Hcb(kAm/s) | (BH)max (KJ/m3) | Hk/Hcj |
|---|---|---|---|---|---|
| 1-1# | 1.251 | 2187 | 976 | 304 | 0.983 |
| 1-2# | 1.253 | 2184 | 976 | 305 | 0.982 |
| 1-3# | 1.249 | 2188 | 974 | 303 | 0.984 |
| 1-4# | 1.268 | 2063 | 992 | 313 | 0.958 |
| 1-5# | 1.267 | 2048 | 991 | 313 | 0.956 |
| 1-6# | 1.268 | 2070 | 994 | 314 | 0.958 |

It can be seen from FIGS. 1A and 1B and Table 1, after the technology and the technique were adopted, the metallographic phase quality of the casting strips was improved, the intrinsic coercivity Hcj of magnet finished products was improved, and residual magnetism was slightly reduced.

Example 2

A formula of the nucleation assisted alloys (A materials) in the example was designed as Pr—$Nd_{28}Fe_{69.09}Co_2B_{0.91}$, with an added weight percent of 5%, where the ingredients of the alloys were calculated before addition of the nucleation assisted alloys according to the design, and ingredients of the intermediate materials were obtained as follows:

Pr—$Nd_{29.47}Tb_{1.05}Fe_{bal}Co_{2.0}B_{0.93}M_{0.59}$ (M=Al, Cu, Zr, Ga), and the intermediate materials accounted for 95 wt % in final (C materials).

The final formula of the C materials was designed as (in a weight percent): Pr—$Nd_{29.4}Tb_1Fe_{bal}Co_{2.0}B_{0.93}M_{0.55}$ (M=Al, Cu, Nb, Ga).

2) The nucleation assisted alloys (A materials) were smelted. The compounded A materials were added into the smelting crucible, vacuumizing was performed until the intensity of pressure was smaller than or equal to 0.5 Pa, and the materials were heated and baked at a low power for 20 minutes. The materials were heated and baked at the largest power of 580 KW until furnace materials were melted through visual observation. Smelting was performed for 5-10 minutes under the condition that the power was reduced by 20-50 KW. The molten steel was poured out when the temperature of the molten steel was in the range of 1450-1480° C. During pouring, the rotating speed of a copper roller wheel of a smelting furnace was about 30-35 r/min, the linear speed of a corresponding molten steel swinging position was 0.96-1.12 m/s, and casting strips with thicknesses of 0.25-1 mm were obtained.

The casting strips were crushed into particles with particle size of about 1-10 mm by the mechanical crushing method, to be used as the nucleation assisted alloys.

3) The Nd—Fe—B casting strips (C materials) were smelted. 570 Kg of the compounded intermediate materials were added into the smelting crucible, vacuumizing was performed until the intensity of pressure was smaller than or equal to 0.5 Pa, and the materials were heated and baked at a low power for 20 minutes. The materials were heated at the largest power of 580 KW until the furnace materials were melted. Smelting was performed for 10-12 minutes after the smelting power was slightly regulated down to 450 KW. The nucleation assisted alloys, namely the A materials, were added through a special tool for later-added materials, arranged at a top end, and after the A materials were added, smelting was performed for 3-5 minutes after the power was regulated down to 300 KW so that the nucleation assisted alloys, namely the A materials, in the molten steel were softened but not in a free atom state completely. The molten steel was poured out when the temperature was in the range of 1410-1420° C. During pouring, the rotating speed of the copper roller wheel of the smelting furnace was about 40-45 r/min, the linear speed of the corresponding molten steel swinging position was 1.28-1.44 m/s, and casting strips with thicknesses of 0.15-0.35 mm were obtained.

Figure 2A:
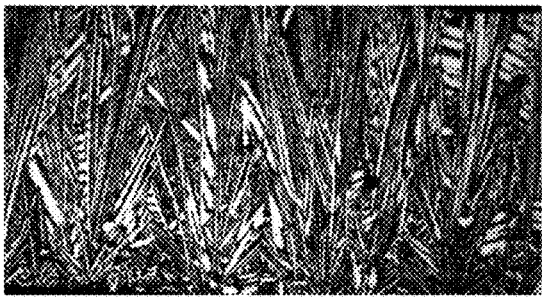
FIGS. 2A and 2B show a comparison of the metallographic phases of the casting strips obtained by the nucleation assisted technique and those by the traditional technology.
Figure 2B:
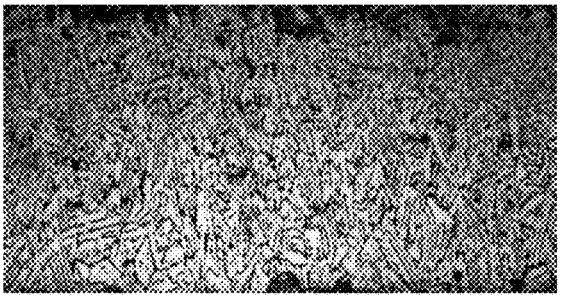

It can be seen from FIGS. 2A and 2B that after the nucleation assisted technique was adopted, the metallographic phase quality of the casting strips was improved, the tetragonal-phase columnar crystals were more sufficient in growth and better in penetration, and an increase of coercivity of magnets was facilitated.

The Nd—Fe—B casting strips were then subjected to conventional crushing and powdering, pressing and forming, and sintering, so that the Nd—Fe—B finished products were obtained. A comparison table of properties of Nd—Fe—B finished products obtained by different technologies with the same ingredients is shown in the following Table 2. 2-1 # to 2-3 # shows the properties of the Nd—Fe—B magnets obtained by adopting the technique disclosed by the present disclosure, and 2-4 # to 2-6 # shows the properties of the Nd—Fe—B magnets obtained by adopting the traditional technology.

TABLE 2

Comparison table of properties of Nd—Fe—B finished products obtained by different technologies with the same ingredients.

| SN | Br(T) | Hcj(kAm/s) | Hcb(kAm/s) | (BH)max (KJ/m3) | Hk/Hcj |
|---|---|---|---|---|---|
| 2-1# | 1.387 | 1675 | 1075 | 370.5 | 0.991 |
| 2-2# | 1.389 | 1669 | 1079 | 370.1 | 0.989 |
| 2-3# | 1.391 | 1673 | 1080 | 372.6 | 0.990 |
| 2-4# | 1.397 | 1548 | 1091 | 376.1 | 0.965 |
| 2-5# | 1.396 | 1562 | 1089 | 375.6 | 0.962 |
| 2-6# | 1.398 | 1563 | 1098 | 376.7 | 0.963 |

It can be seen from FIGS. 2A and 2B and Table 2, after the technology and the technique were adopted, the metallographic phase quality of the casting strips was improved, the intrinsic coercivity Hcj of Nd—Fe—B finished products was improved, and residual magnetism was slightly reduced.

What is claimed is:

1. A method for preparing a sintered Nd—Fe—B casting strip, the method comprising the following steps:

1) preparing nucleation assisted alloy particles used for the sintered Nd—Fe—B casting strip;

1.1) weighing the following nucleation assisted alloy particle elements: 26.68-28 wt % of Pr—Nd, 70-72.5% of Fe and 0.90-1% of B, wherein a Pr element in two elements of Pr—Nd accounts for 0-30 wt %, and obtaining an alloy strip with a proportion of ingredient atoms close to that of $(Pr—Nd)_2Fe_{14}B$ through conventional compounding, smelting and pouring; and 1.2) crushing the alloy strip into particles with a diameter in the range from 1-10 mm, to serve as the nucleation assisted alloy particles used for the sintered Nd—Fe—B casting strip;

2) preparing the sintered Nd—Fe—B casting strip;

2.1) providing an intermediate material, wherein composition of the intermediate material is calculated according to the composition of the Nd—Fe—B casting strip to be prepared and an additional quantity of the nucleation assisted alloy particles, and the additional quantity of the nucleation assisted alloy particles is in the range from 3-6% by weight, based on a total weight of the sintered Nd—Fe—B casting strip; and 2.2) melting the intermediate material and smelting for 10-20 minutes to obtain a smelted intermediate material, adding the nucleation assisted alloy particles into the smelted intermediate material, further smelting for 3-15 minutes under a condition that power is reduced by 150-250 KW from a power for smelting the intermediate material, and pouring, thereby obtaining the sintered Nd—Fe—B alloy casting strip.

2. The method as claimed in claim 1, wherein the step of crushing further comprises mechanical crushing or hydrogen crushing.

3. The method as claimed in claim 2, wherein the step of crushing comprises hydrogen crushing, and hydrogen crushing further comprises dehydrogenation and hydrogen content in the nucleation assisted alloy particles is smaller than 1000 ppm.

4. The method as claimed in claim 1, wherein the additional quantity of the nucleation assisted alloy particles is 5% by weight, based on a total weight of the sintered Nd—Fe—B casting strip.

5. The method as claimed in claim 2, wherein the additional quantity of the nucleation assisted alloy particles is 5% by weight, based on a total weight of the sintered Nd—Fe—B casting strip.

6. The method as claimed in claim 3, wherein the additional quantity of the nucleation assisted alloy particles is 5% by weight, based on a total weight of the sintered Nd—Fe—B casting strip.

7. The method as claimed in claim 1, wherein in the step 1.1, an Fe element in the nucleation assisted alloy particles is replaced with a Co element, and the Co element accounts for 0-5 wt % of the nucleation assisted alloy particles.

8. The method as claimed in claim 2, wherein, in the step 1.1, an Fe element in the nucleation assisted alloy particles is replaced with a Co element, and the Co element accounts for 0-5 wt % of the nucleation assisted alloy particles.

9. The method as claimed in claim 3, wherein in step 1.1, an Fe element in the nucleation assisted alloy particles is replaced with a Co element, and the Co element accounts for 0-5 wt % of the nucleation assisted alloy particles.

* * * * *